US005190229A

United States Patent [19]

Kaiser

[11] Patent Number: 5,190,229

[45] Date of Patent: Mar. 2, 1993

[54] ROLLING BEARING ARRANGEMENT FOR A CONICAL CRUSHER

[75] Inventor: Theodor Kaiser, Höchstadt/Aisch, Fed. Rep. of Germany

[73] Assignee: INA Walzlager Schaeffler KG, Fed. Rep. of Germany

[21] Appl. No.: 740,104

[22] Filed: Aug. 5, 1991

[30] Foreign Application Priority Data

Oct. 27, 1990 [DE] Fed. Rep. of Germany ..... 4034220

[51] Int. Cl.[5] ..... B02C 2/04

[52] U.S. Cl. ..... 241/207; 241/215

[58] Field of Search ..... 241/207, 214, 215, 30

[56] References Cited

U.S. PATENT DOCUMENTS 4,671,464 6/1987 Karra et al. ..... 241/30

FOREIGN PATENT DOCUMENTS 0900650 11/1953 Fed. Rep. of Germany ..... 241/215

3401722 7/1985 Fed. Rep. of Germany .

2019246 10/1979 United Kingdom ..... 241/207

*Primary Examiner*—Douglas D. Watts

*Assistant Examiner*—Allan M. Schrock

*Attorney, Agent, or Firm*—Bierman and Muserlian

[57] ABSTRACT

A rolling bearing arrangement for a conical crusher in which a vertically arranged driving element is rotatably mounted on a base and a crushing cone is mounted inclined with respect to the vertical on the upper end of the driving element so as to be freely rotatable, characterized in that the rolling bearing arrangement comprises a single common hollow cylindrical outer part in which two inner rings situated axially behind each other are supported on rolling elements, the outer part being part of the driving element and the first inner ring being connected with the base whereas the second inner ring, which is arranged inclined and eccentrically offset with regard to the first inner ring, carries the crushing cone.

1 Claim, 1 Drawing Sheet

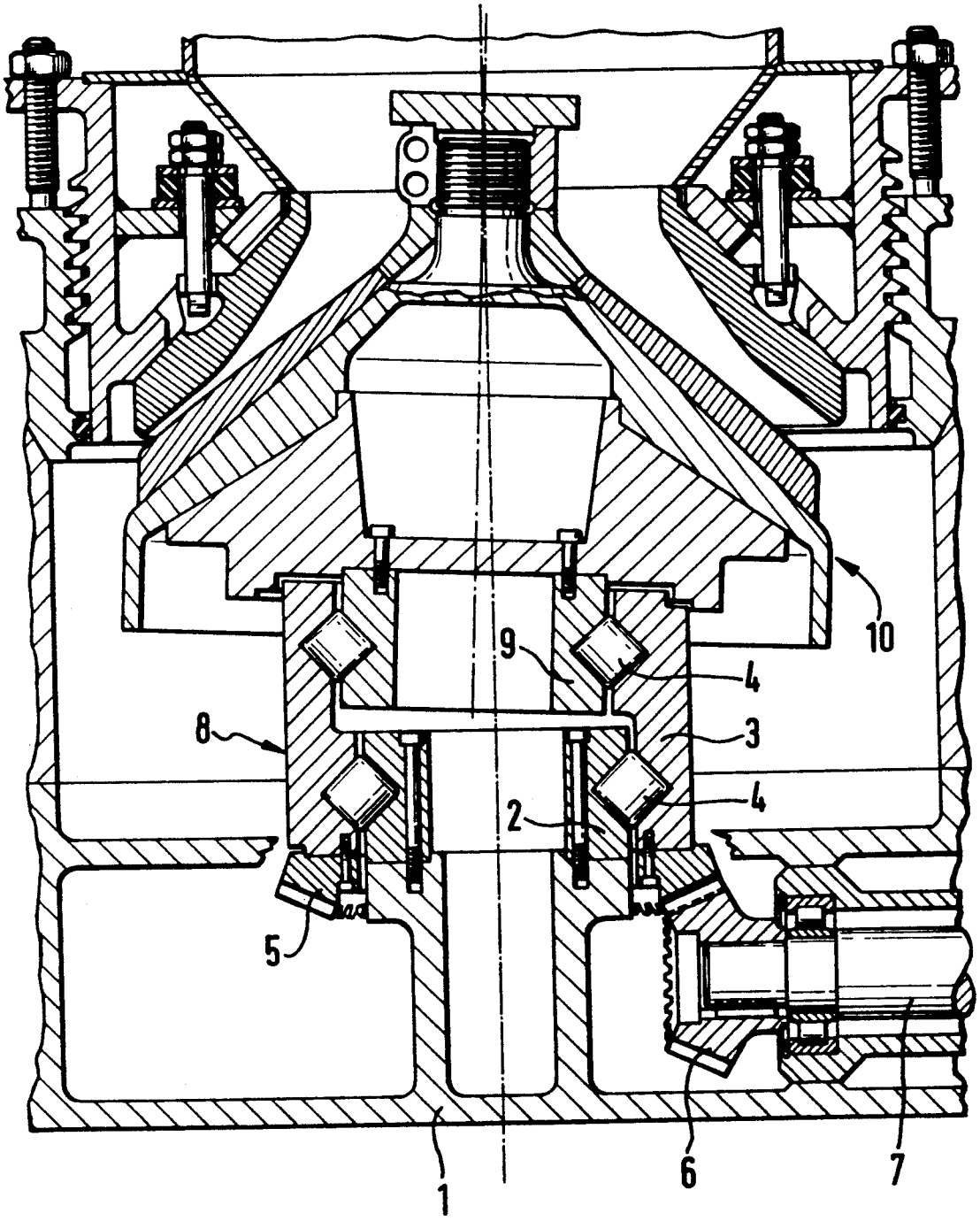
10
9
4
8
3
4
2
5
1
6
7

ROLLING BEARING ARRANGEMENT FOR A CONICAL CRUSHER

STATE OF THE ART

Rolling bearing arrangements for a conical crusher in which a vertically arranged driving element is rotatably mounted on a base and a crushing cone is mounted inclined with respect to the vertical on the upper end of the driving element so as to be freely rotatable are known. DE-S 3,401,722 shows such a rolling bearing arrangement in which a vertical motor-driven shaft is mounted in a base by means of a rolling bearing. On its upper end, this shaft carries a second rolling bearing which is arranged inclined and eccentrically offset with respect to the first rolling bearing and supports the crushing cone on its other end. Since these rolling bearings are externally unprotected, complicated sealing measures have to be adopted in this known construction to adequately protect the bearings from the dust arising in operation.

OBJECTS OF THE INVENTION

It is an object of the invention to provide a more compact, and thus simpler and less expensive bearing arrangement for a conical crusher as compared to the State of the Art and which moreover poses substantially less sealing problems than known bearing arrangements.

This and other objects and advantages of the invention will become obvious from the following detailed description.

THE INVENTION

The novel roller bearing arrangement of the invention for a conical crusher in which a vertically arranged driving element is rotatably mounted on a base and a crushing cone is mounted inclined with respect to the vertical on the upper end of the driving element so as to be freely rotatable, is characterized in that the rolling bearing arrangement comprises a single common hollow cylindrical outer part in which two inner rings situated axially behind each other are supported on rolling elements, the outer part being part of the driving element and the first inner ring being connected with the base whereas the second inner ring, which is arranged inclined and eccentricaly offset with regard to the first inner ring, carries the crushing cone.

By the fact that the common outer ring covers the inner space containing the rolling elements, it is only between the upper end of the outer race ring and the crushing cone that there is a gap which requires sealing and this can be sealed in a known manner with labyrinth seals. The bearing gap, on the other hand, is situated at the lower end in the region of the base, in which also the driving means are located. This space is separated from the part of the conical crusher in which dust arises.

Referring now to the drawing:

The Fig. is a longitudinal section of an example of an embodiment of the invention.

A first inner ring 2 of a rolling bearing is screwed onto the base 1 of the conical crusher. Between this ring and the outer ring 3 of the rolling bearing, cylindrical rollers 4 roll, which are arranged in a known manner as cross-rollers, that is to say that the axes of successive cylindrical rollers are at an angle of 90° to each other as known. A gear rim 5, into whose toothing the bevel pinion 6, fixed for example in a known manner, not represented, to the electromotor-driven driving shaft 7, engages, is screwed onto the lower end of the outer ring 3. The outer ring 3 together with the gear rim 5 forms the driving element 8 of the conical crusher.

A second set of cylindrical rollers 4 is arranged in the upper region of the outer ring 3 with the rollers rolling in a second inner ring 9 which is arranged inclined and eccentrically offset with regard to the first inner ring 2. The crushing cone 10 is screwed onto this second inner ring 9. The rolling bearing arrangement of the invention does not change anything in the functioning of the crushing cone as compared to known constructions. It is only the bearing arrangement itself that has been simplified and particularly the considerable sealing problems of conventional bearing arrangements that have been eliminated.

It is understood that the invention is not limited to a rolling bearing arrangement using cross-rollers as rolling elements. On the contrary, every kind of known rolling bearing arrangement can be used which is able to absorb radial and axial forces as well as such moments of tilt as may occur.

Various other modifications of the bearing arrangement may be made without departing from the spirit or scope thereof and it is to be understood that the invention is intended to be limited only as defined in the appended claims.

What I claimed is:

1. A conical crusher, comprising a vertically arranged driving element (8) is rotatably mounted on a base (1) as to be freely rotatable with first and second inner races (2, 9), the second inner race (9) adjacent to the crusher cone (10) is inclined with respect to the first inner race (2) and offset eccentrically with respect to the first inner race (2), a rolling bearing arrangement consisting of a single common hollow cylindrical outer part (3) in which the two inner races (2,9) are supported on rolling elements (4), the outer part being part of the driving element (8) and the first inner race (2) being connected with the base (1) whereas the second inner race (9) carries a crushing cone (10).

* * * * *